US006814520B1

(12) United States Patent
Delli Venneri et al.

(10) Patent No.: US 6,814,520 B1
(45) Date of Patent: Nov. 9, 2004

(54) DEVICE FOR DISPENSING A FLUID PRODUCT FROM A CONTAINER

(75) Inventors: Nicola Delli Venneri, Meerbusch (DE); Frank Roemer, Finnentrop (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 113 days.

(21) Appl. No.: 10/129,290

(22) PCT Filed: Oct. 26, 2000

(86) PCT No.: PCT/EP00/10536

§ 371 (c)(1),
(2), (4) Date: Sep. 12, 2002

(87) PCT Pub. No.: WO01/32050

PCT Pub. Date: May 10, 2001

(30) Foreign Application Priority Data

Nov. 4, 1999 (DE) ..... 199 53 258

(51) Int. Cl.[7] ..... B43K 23/08
(52) U.S. Cl. ..... 401/213; 401/209
(58) Field of Search ..... 401/208, 209, 401/213, 214, 216

(56) References Cited

U.S. PATENT DOCUMENTS

| | | | | |
|---|---|---|---|---|
| 2,081,673 A | | 5/1937 | Olson | 91/67.4 |
| 2,912,708 A | | 11/1959 | Schaich | 15/132.7 |
| 3,055,041 A | | 9/1962 | Schaich | 15/572 |
| 3,103,691 A | | 9/1963 | Stull | 15/572 |
| 5,842,806 A | | 12/1998 | Rettke | 401/213 |
| 6,488,431 B1 | * | 12/2002 | Bocola | 401/216 |

FOREIGN PATENT DOCUMENTS

| | | |
|---|---|---|
| CA | 1 078 783 | 6/1980 |
| DE | 27 24 099 | 3/1978 |
| DE | 195 21 508 | 5/1996 |
| FR | 2 623 476 | 5/1989 |

* cited by examiner

*Primary Examiner*—Gregory L. Huson
*Assistant Examiner*—Huyen Le
(74) *Attorney, Agent, or Firm*—Stephen D. Harper; Gregory M. Hill

(57) ABSTRACT

A dispenser is provided for dispensing a flowable product from a container. The dispenser includes a roller applicator having a roller housing and roller rotatably mounted on the roller housing. The dispenser also includes an openable closure and sealing elements. The closure pivots relative to the roller to provide an open position in which the roller is uncovered and a closed position in which the roller is covered by the closure to the outside. The sealing elements are located between the roller and the roller housing and are activated by turning the closure into the closed position.

5 Claims, 6 Drawing Sheets

Fig. 8
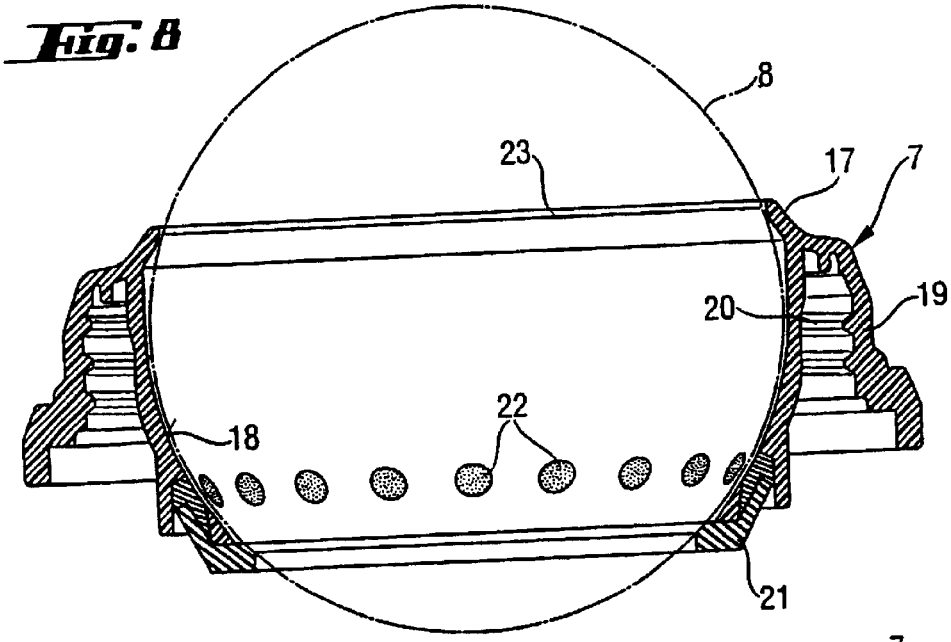
Fig. 10
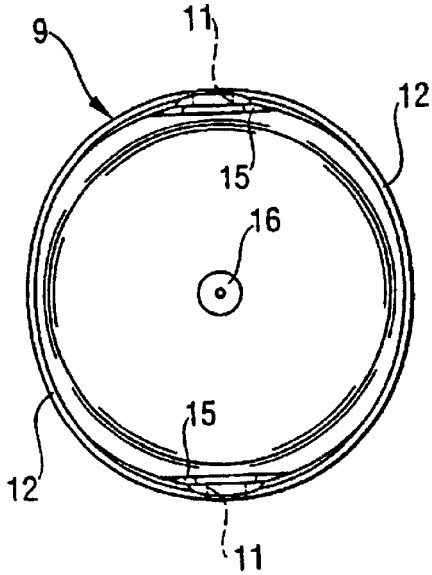
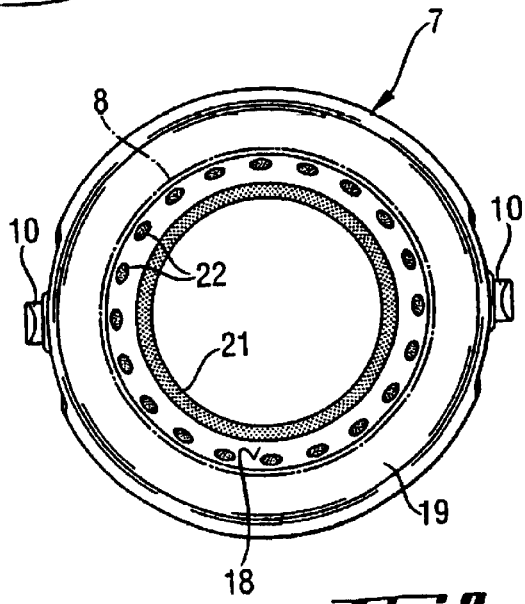
Fig. 9

DEVICE FOR DISPENSING A FLUID PRODUCT FROM A CONTAINER

CROSS REFERENCE TO RELATED APPLICATIONS

This application is a national stage application under 35 U.S.C. § 371 of international application PCT/EP00/10536 filed on Oct. 26, 2000, the international application not being published in English. This application also claims priority under 35 U.S.C. §119 to DE 199 53 258.3, filed on Nov. 4, 1999.

This invention relates to a dispenser for dispensing a flowable product from a container comprising a roller applicator which closes the container opening to the outside and which comprises a housing for a roller in which the roller is mounted for rotation, the roller projecting locally inwards into the container from the roller housing and being designed to be wetted by the flowable product in use and an openable closure which covers the roller to the outside, sealing elements being provided between the roller and the roller housing.

One such dispenser designed in particular for dispensing a liquid deodorant is known, for example, from DE 195 21 508 A1. In this known dispenser, the roller applicator is said to be designed in such a way that, on the one hand, it closes the opening of the container securely when the deodorant is not in use and, on the other hand, allows the liquid to flow out when the deodorant is being applied. In the known dispenser, this is said to be achieved by the fact that the roller is mounted firmly for rotation about its axis and by the fact that the container opening is designed to be closed by a closure element of a slide closure. A closure cap designed to be placed on the container is also provided. Since the roller of the known dispenser can only move with a degree of freedom in the roller housing, i.e. can only rotate about its axis, the roller can be supported underneath by a cup of the roller housing communicating with the container opening so that, when the deodorant is in use, the flow of liquid and hence the degree of wetting of the roller can be determined through the distance between the roller and the cup. However, the handling behavior of such a dispenser is still not satisfactory because, on the one hand, the form of application is limited insofar as the roller is only able to rotate with a degree of freedom. Accordingly, if the user wants to distribute the liquid over a relatively large area, for example over the underarm region, he/she has to apply the roller applicator possibly several times in parallel adjacent strokes. On the other hand, it is a disadvantage that the user has to remove and replace the closure cap before and after using the dispenser because, without the closure cap, the dispenser is not sufficiently leak-proof.

DE 27 24 099 A1, for example, discloses a dispenser of the type mentioned at the beginning comprising a roller applicator with a ball-like roller which simplifies application of the product to the skin. However, this dispenser also requires a closure cap which, in the closed position, presses from inside against sealing elements of the roller housing and, in doing so, closes and seals the container. Accordingly, the closure cap again has to be removed before use and replaced after use which makes the dispenser correspondingly inconvenient to handle. In addition, this known dispenser like the other dispensers of this type often has the disadvantage that the wetting of the roller with liquid product is unsatisfactory, particularly when the dispenser is used for the first time, so that the user frequently has to turn the roller several times with a finger. This is clearly awkward and inconvenient.

FR-A-2 623 476 describes a dispenser with a roller applicator which does not communicate with the contents of the container directly but via a channel which is designed to be opened and closed by a pivotable closure. In the closed position of the closure where the roller is covered to the outside by the closure, the channel is aligned in such a way that it does not establish a connection between the roller and the interior of the container. By contrast, in the opened position of the closure, a connection is established. However, a dispenser such as this is only suitable and intended for dispensing a paste-like product. It is not suitable for use as a dispenser, for example for liquid deodorants.

The problem addressed by the present invention was to improve a dispenser of the type mentioned at the beginning in such a way that the handling behavior of the dispenser would be considerably improved without any adverse effect on the sealing function of the dispenser when it is not in use.

In a dispenser of the type mentioned at the beginning, the solution to this problem as provided by the invention is characterized in that the closure is designed to pivot relative to the roller in such a way that it can be turned into an open position in which the roller is uncovered and into a closed position in which the roller is covered to the outside, the sealing elements being designed in such a way that they become fully active by turning of the closure into the closed position.

In contrast to known dispensers of this type, therefore, the dispenser according to the invention does not require a closure cap which has to be removed to use the dispenser and then replaced after use. Instead, the closure remains on the dispenser or rather the container. It merely has to be turned into the open and closed positions. The closure may easily be designed in such a way that, in the closed position, it closes the roller to the outside so that, in conjunction with suitable sealing elements, a satisfactory sealing function is also guaranteed. Operating errors are almost completely avoided by the one-piece design of the container and closure. This is because, when the pivotally mounted closure is turned into the closed position which is clearly recognisable to the user because the roller is no longer visible in this position, the design of the sealing elements in conjunction with the closure automatically ensures that the sealing elements are in their fully activate position.

In addition, it is readily possible given suitable geometry of the closure to bring the closure automatically into friction contact with the roller through the pivoting movement from the closed into the open position and vice versa, so that the roller is rotated during the pivoting movement of the closure, which ensures automatic wetting of the roller with product so that subsequent application of the product is considerably simplified because there is no need for complicated actuation of the roller with the fingers or the like.

In a preferred embodiment, there is at least one projection on the inside of the closure which presses the roller inwards against the sealing elements when the closure is turned into the closed position. In this way, the complete activation of the sealing elements when the closure is closed is achieved by a particularly simple design measure.

In another preferred embodiment, the closure is pivotally connected to the roller housing. All the components of the dispenser thus form a preassembled unit which is suitable for fitting to a container. Alternatively, however, the closure may also be pivotally connected to the container itself.

In one particularly preferred embodiment which is ergonomically very favorable and which further simplifies handling, the closure is designed in the manner of a part-spherical hinged visor. For opening and closing, the closure may be thus be handled in the same way as hinged visors of, for example, motorcycle helmets.

Where the closure is designed in this way, another particularly preferred embodiment of the invention is characterized in that the roller housing forms a ball-like shape together with the roller partly projecting from the housing and that part of the container where the container opening is situated. Accordingly, both in the open and in the closed position, the part-spherical closure bears almost completely against the container or rather the roller so that it is not problematical. In addition, this embodiment of the dispenser is particularly attractive in appearance.

As mentioned above, the dispenser can form a preassembled unit, in which case the roller housing —in one particularly preferred embodiment—is detachably fixed to the container. In this way, the container can be refilled with product as required, in addition to which various types of container can be fitted with one and the same dispenser so that various designs can be used. A series consisting of several different dispensers is easier to produce. However, the housing may also be snap- or press-fitted onto the container. In that case, re-use of the dispenser is not normally envisaged.

In order further to simplify handling, stops for limiting the pivoting movement of the closure are provided on the closure and/or on the roller housing and/or on the container. In one particularly advantageous embodiment, detent elements are associated with the stops. Thus, corresponding detent elements may be provided, for example, to ensure that, when the dispenser is in use, the closure remains in its open position. The same provisions may also be made for the closed position.

The invention is described in more detail in the following with reference to the accompanying drawings, wherein:

FIG. 8 is a longitudinal section through the roller housing (with roller) of the dispenser according to the invention.

FIG. 9 is a view from beneath of FIG. 8.

FIG. 10 is a view from beneath of the closure of the dispenser according to the invention.

Figures 1, 2:
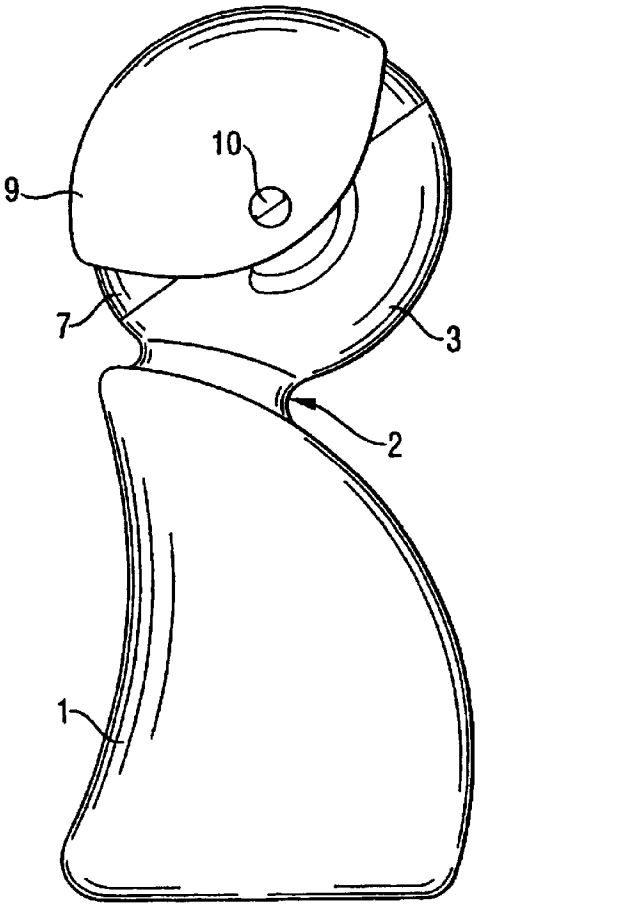
FIG. 1 is a side elevation of a container fitted with a dispenser according to the invention in the open in-use position.
FIG. 2 is a view from the left of the container illustrated in FIG. 1.

A container for a flowable product, for example a liquid deodorant, is generally denoted by the reference numeral 1 in the drawings. In the illustrated embodiment, the container 1 is designed to held by hand and, to this end, has a particularly favorable, ergonomically designed outer contour which tapers into a neck at its upper end 2. This region is adjoined by a substantially hemispherical head region 3 which opens into a container opening 5 via a slightly tapered region formed with an external screwthread 4.

The external screwthread of the head region 3 of the container 1 is provided to enable a dispenser according to the invention for dispensing the flowable product from the container 1, as described in more detail hereinafter, to be screwed onto the container 1. The dispenser may even form part of the container 1, i.e. may be non-detachably arranged thereon, although this has not been shown in the drawings. In addition, the dispenser may be snap- or press-fitted onto the container.

Figure 14:
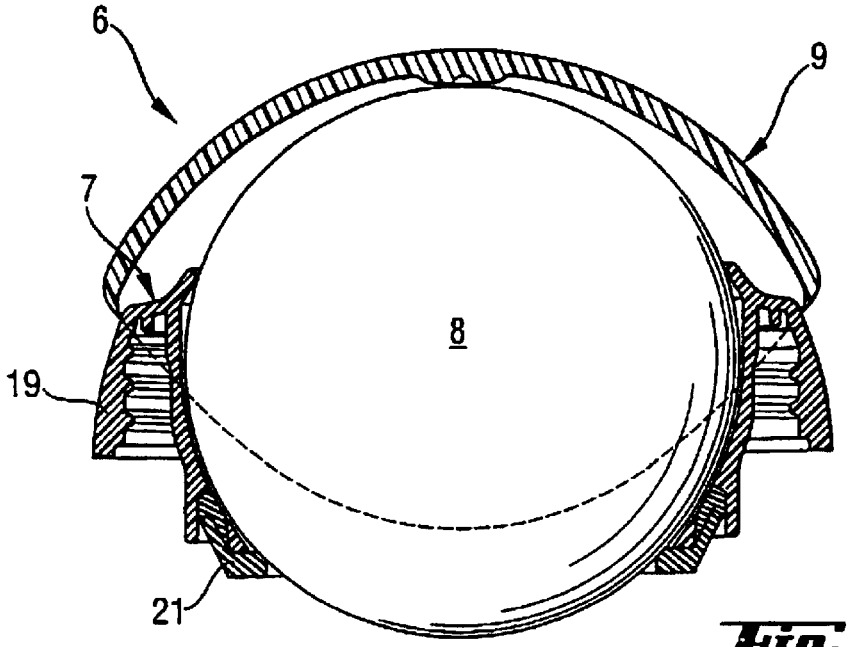
FIG. 14 is another section, but only through the dispenser according to the invention.

The dispenser according to the invention, which is generally denoted by the reference numeral 6 (FIG. 14), first of all comprises a roller applicator which incorporates a roller housing 7 and a roller 8 which is spherical in the illustrated embodiment and rotatably mounted in the roller housing 7. As can be seen from the drawings, the spherical roller 8 is mounted in the roller housing 7 in such a way that it projects partly inwards into the region of the container opening 5 and partly outwards from the roller housing 7. As can best be seen from FIGS. 1 to 4, the outer contour of the roller housing 7 in conjunction with the projecting part of the roller 8 is designed in such a way that, when the dispenser 6 is fitted to the container 1, these parts form a substantially ball-like shape together with the hemispherical head region 3 of the container 1.

In addition, the dispenser 6 according to the invention comprises an openable closure which covers the roller 8 from the outside when the dispenser is not in use and which, according to the invention, is designed to pivot relative to the roller 8 in such a way that it can be turned into an open position in which the roller 8 is uncovered and into a closed position in which the roller 8 is covered to the outside.

To this end, the pivotal closure 9—in the illustrated embodiments—is pivotally connected to the roller housing 7 (corresponding pivot pins on opposite outsides of the roller housing 7 are denoted by the reference numeral 10). Openings 11 for the pins 10 to pass through are correspondingly provided in the closure 9.

In adaptation to the shape of the hemispherical head region 3 of the roller housing 7 and the spherical roller 8, the closure 9 is preferably designed in the manner of a part-spherical hinged visor, as shown in the illustrated embodiments.

As can readily be seen from FIGS. 1 to 4, the closure 9 can thus be turned from the open position (roller 8 freely accessible from outside, FIGS. 1 and 3) into the closed position (FIGS. 2 and 4) in which the roller 8 is covered to the outside by the closure 9. In the open position shown in FIGS. 1 and 3, the container 1 fitted with the dispenser 6 can be used in the same way as a normal deodorant roller. In order to prevent the closure 9 from being turned into the closed position through careless handling, stops are provided on the closure 9 and/or on the roller housing 7 and/or on the container 1. In the case of the closure 9 for example, these stops are formed by edge regions 12 thickened on the inside which may also serve as detent elements. In addition, arcuate guide indentations 13 adapted to the path of the pivoting movement may be provided on both sides of the head region 3 of the container 1 adjoining the pivot pins 10 of the roller housing 7. The indentations 13 open into an end stop 14 and co-operate with projections 15 provided on the inside adjacent the openings 11 in the closure 9. When the closure 9 is pivoted into the open position, the projections 15 are able to slide along the guide indentation 13 until they encounter the end stop 14 in the fully open position of the closure 9. Alternatively, the openings and stops also be oppositely arranged, i.e. on the container instead of the closure and vice versa.

The closure 9 is stopped and held in the closed position by the thickened stops 12 facing one another on either side of the closure which come into contact with the upper encircling annular edge region 17 of the roller housing 7.

The construction of the roller housing 7 is shown in detail in FIGS. 8 and 9. The roller housing 7 first of all comprises an inner part-spherical holding region 18 which is adapted to the geometry of the spherical roller 8 and which is adjoined on the outside by an annular connector 19 with an internal screwthread 20 which co-operates with the external screwthread 4 of the container 1. By suitably designing the threads 20 and 4 and/or by providing suitable stops on the container 1 and the roller housing 7, the roller housing 7 is able to assume the position shown in FIGS. 1 to 4 after it has been fully screwed onto the head 3 of the container 1, thus enabling the closure 9 to pivot satisfactorily. The screw connection may also be replaced by a releasable or fixed snap fit.

A sealing element 21 which may be an integral part of, or may be formed on, the roller housing 7 is provided in the lower part of the roller housing 7 which projects into the container 1. The geometry of the roller housing 7 with the sealing element 21 in relation to the roller 8 is such that, when the closure 9 is open, the roller 8 is not fully sealed off from the interior of the container 1; instead, when the roller 8 rotates, that part which projects into the container 1 is able to pass after wetting into the region accessible from outside without any significant loss of liquid so that the product can be applied.

The upper edge 23 of the roller housing 7 preferably has a lip contour so that, in the upside-down position of the container 1, the spherical roller bears so precisely against the lip 23 that unwanted leakage of the product is avoided.

Figure 4:
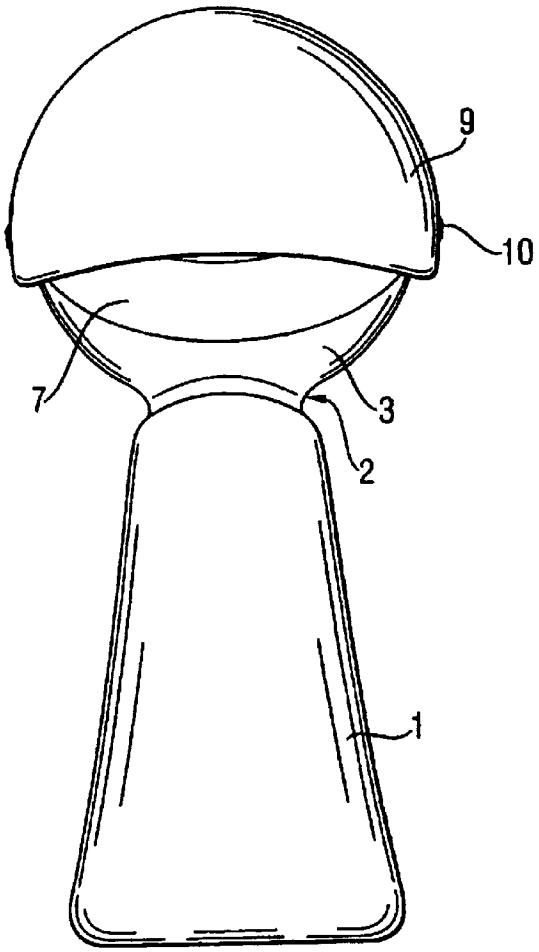
FIG. 4 is a view from the left of the container illustrated in FIG. 3.
Figure 3:
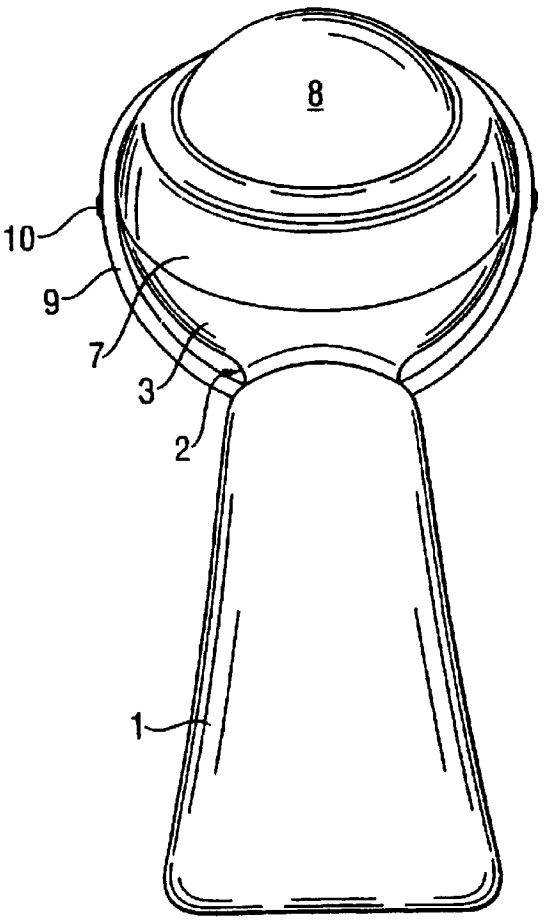
FIG. 3 shows the container illustrated in FIG. 1 in the closed out-of-use position.
Figure 6:
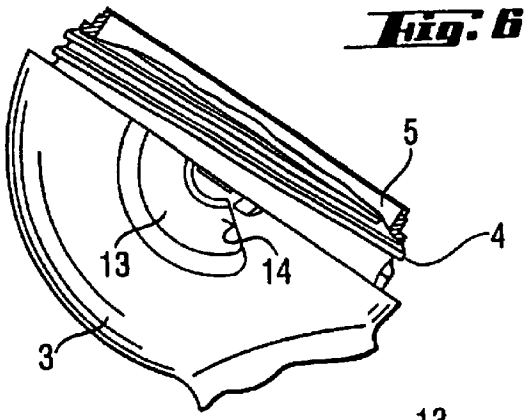
FIG. 6 is a view on an enlarged scale showing part of the container illustrated in FIG. 5 with the container opening.
Figure 7:
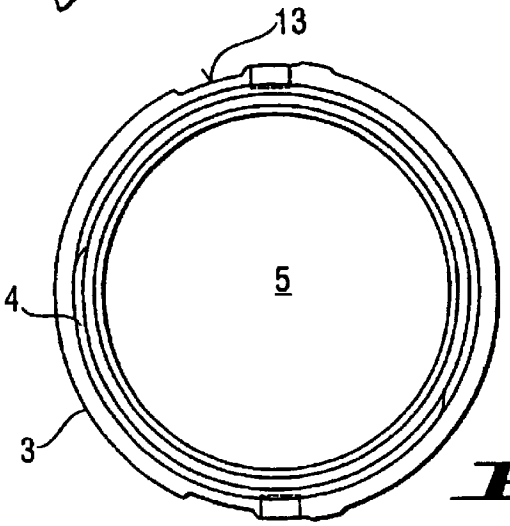
FIG. 7 is a plan view of the container opening shown in FIG. 6.
Figure 5:
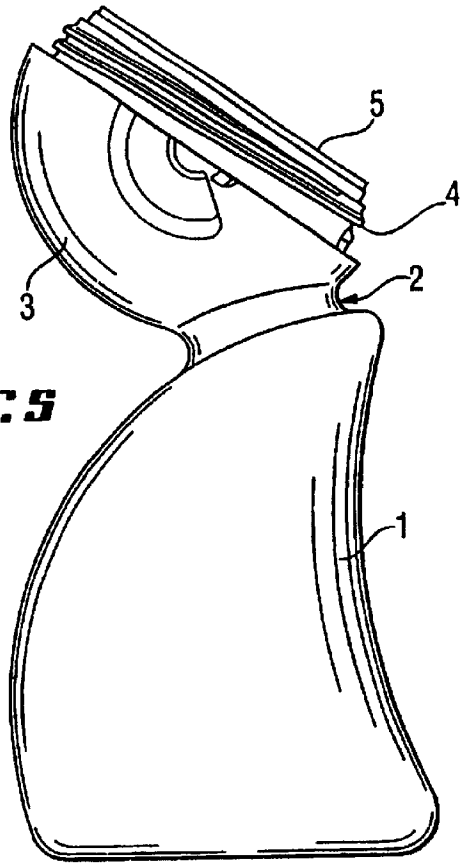
FIG. 5 is a side elevation of a container without the dispenser according to the invention.
Figure 11:
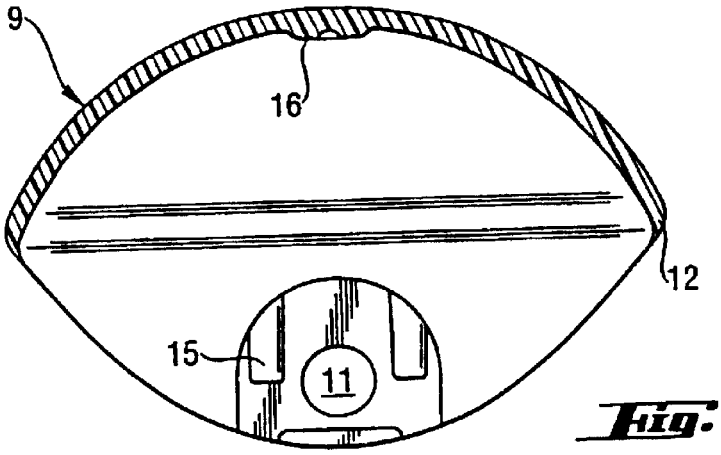
FIG. 11 is a side elevation—partly in section —of the closure shown in FIG. 10.
Figure 12:
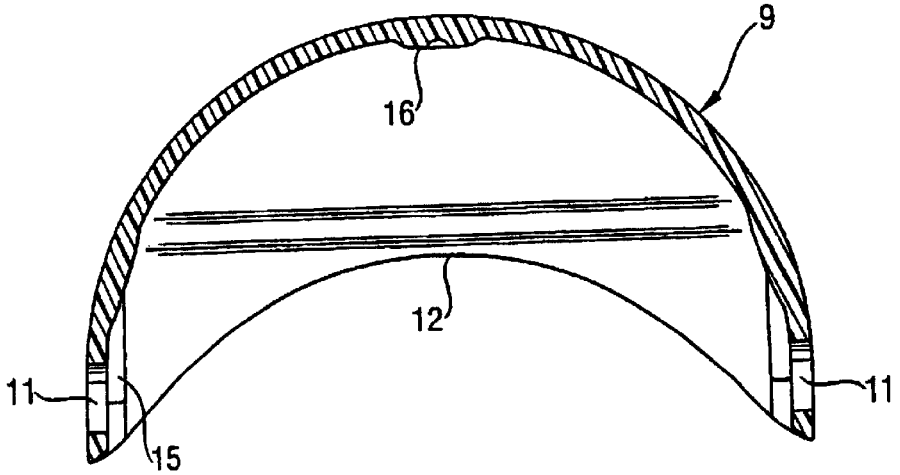
FIG. 12 is a view from the left of the closure illustrated in FIG. 11.
Figure 13:
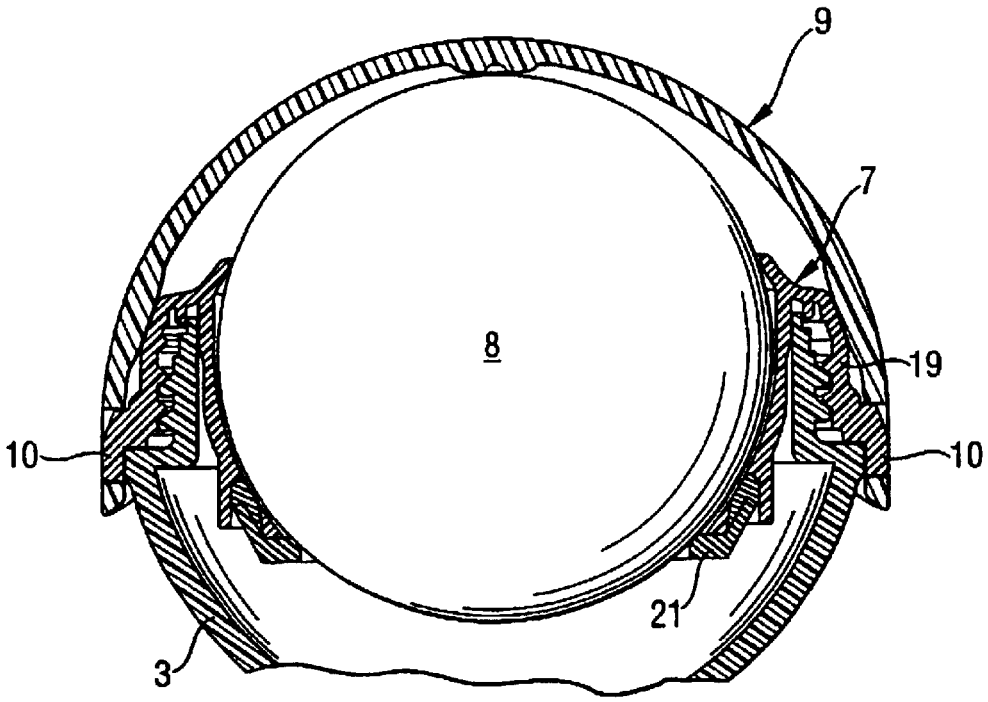
FIG. 13 is a longitudinal section through the upper part of the container with the dispenser according to the invention in the open position of the closure.

The mode of operation of the dispenser 6 according to the invention is as follows:

Starting from the closed position of the closure 9, as shown in FIGS. 3 and 4, the user is able to take the container 1 in one hand and to turn the closure 9, for example using only the thumb of that hand, into the open position shown in FIG. 1, the maximum pivoting angle being determined by the stops and detents mentioned in the foregoing. The container with the dispenser 6 is thus immediately ready for use, i.e. product can be immediately applied to the skin by the roller 8 without any need for further measures, for example complicated finger manipulation of the roller 8.

After use, the closure 9 is turned back into its closed position. During this closing movement, the container 1 is normally held upright by the user. During the pivoting movement of the closure 9, a pressure is automatically applied to the roller 8 axially towards the sealing element 21 of the roller housing 7 under the effect of the stops 12 and, above all, under the effect of the raised projection-like pressure element 16, the pressure element 16 remaining under pressure in the closed position. The effect of this is that the roller 8 bears sealingly against the sealing element 21 so that the container 1 is sealed in the closed position. In addition, the upwardly projecting part of the roller 8 is largely sealed off from outside by the closure 9.

The opening and closing movement is supported by actuating means (not shown) positioned on top of the closure 9. The actuating means extend transversely of the direction of movement of the closure 9 and are raised so that the thumb does not slide off during actuation. The area occupied by the actuating means substantially corresponds to the area of the tip of the thumb. In addition, indicating means, such as arrows, may also be provided to show the user where to apply the thumb and/or to indicate the direction of movement.

The invention is not of course confined to the embodiments illustrated. Other embodiments are possible without departing from the basic concept. Thus, the roller housing 7 may be made as required of one or more materials to enable the various properties of this component to be optimally developed.

More particularly, the region of the sealing element 21, which may also be designed to function as a stripper, can be made sufficiently flexible and elastic in co-operation with the roller 8 and the closure by a suitable choice of material. By suitably selecting and dimensioning these elements in conjunction with the free space of the roller 8 in the roller housing 7, it is possible to influence how much product the roller 8 takes up on its way to the point of application.

In one embodiment (not shown), the pivoting movement of the closure is limited by the shape of the roller housing. In the open position, the front edge of the closure —in the direction of the opening movement—bears against the neck-like taper between the hemispherical head region and the container. In the closed position, the rear edge strikes against a stop located below the container opening so that the edge of the closure and the stop bear interlockingly against one another.

What is claimed is:

1. A dispenser for dispensing a flowable product from a container comprising (a) a roller applicator which is capable of covering an opening of a container wherein the roller applicator comprises
  (i) a roller housing, and
  (ii) a roller rotatably mounted in the roller housing, wherein the roller projects inwards into the container from the roller housing and is capable of being wetted by the flowable product;

(b) an openable closure in the form of a part-spherical hinged visor having an inside surface, wherein the closure is pivotally connected to the roller housing and pivots relative to the roller to provide an open position in which the roller is uncovered and a closed position in which the roller is covered at least in part by the closure wherein the closure, the roller housing or the container, or combinations thereof comprise one or more stops for limiting the pivoting movement of the closure wherein the one or more stops prevent the unintentional pivoting of the closure from one position to another position; and (c) one or more sealing elements located between the roller and the roller housing, wherein the sealing elements are activated by turning the closure into the closed position to provide a seal between the container and the dispenser.

2. The dispenser of claim 1 wherein the closure has at least one projection on the inside surface of the closure which presses the roller inwards against the sealing elements to provide the seal when the closure is in the closed position.

3. The dispenser of claim 2 wherein one or more of the stops have an associated detent element.

4. A dispenser for dispensing a flowable product from a container comprising (a) a roller applicator comprising
(i) a roller housing, and
(ii) a roller rotatably mounted in the roller housing, wherein the roller projects above and below the roller housing;

(b) an openable closure in the form of a part-spherical hinged visor having an inside surface, wherein the closure pivots is pivotally connected to the roller housing and relative to the roller to provide an open position in which the roller is uncovered and a closed position in which the roller is covered at least in part by the closure wherein the closure, the roller housing or the container, or combinations thereof comprise one or more stops for limiting the pivoting movement of the closure wherein the one or more stops prevent the unintentional pivoting of the closure from one position to another position; and (c) one or more sealing elements located between the roller and the roller housing, wherein the sealing elements are activated by turning the closure into the closed position to press the roller against the sealing elements.

5. An apparatus for dispensing a flowable product comprising:

(a) a container having an opening for dispensing a flowable product;

(b) a roller applicator which covers the opening of the container, wherein the roller applicator comprises
(i) a roller housing, and
(ii) a roller rotatably mounted in the roller housing, wherein the roller protects inwards into the container from the roller housing and is capable of being wetted by the flowable product;

(c) an openable closure in the form of a part-spherical hinged visor having an inside surface, wherein the closure is pivotally connected to the roller housing and pivots relative to the roller to provide an open position in which the roller is uncovered and a closed position in which the roller is covered at least in part by the closure wherein the closure, the roller housing or the container, or combinations thereof comprise one or more stops for limiting the pivoting movement of the closure wherein the one or more stops prevent the unintentional pivoting of the closure from one position to another position; and (d) one or more sealing elements located between the roller and the roller housing, wherein the sealing elements are activated by turning the closure into the closed position to provide a seal between the container and the roller.

* * * * *